United States Patent [19]

Karl

[11] 4,238,981

[45] Dec. 16, 1980

[54] ELECTRIC CABLE PROCESSING

[75] Inventor: Walter Karl, Sydney, Australia

[73] Assignee: Utilux Pty. Limited, Australia

[21] Appl. No.: 6,179

[22] Filed: Jan. 24, 1979

[30] Foreign Application Priority Data

Feb. 1, 1978 [AU] Australia ..... PD3213

[51] Int. Cl.[3] ..... B26D 7/06; H01R 43/04; B26D 5/00

[52] U.S. Cl. ..... 83/151; 29/564.6; 81/9.51; 83/158; 83/208; 83/250; 83/436

[58] Field of Search ..... 83/151, 154, 277, 71, 83/250, 208, 436, 158; 81/9.51; 29/564.4, 753, 564.6; 140/1

[56] References Cited

U.S. PATENT DOCUMENTS

| | | | |
|---|---|---|---|
| 3,029,494 | 4/1962 | Andren | 83/151 |
| 3,369,434 | 2/1968 | Schwalm | 83/151 X |
| 3,701,301 | 10/1972 | Gudmestad | 83/151 |
| 3,927,590 | 12/1975 | Gudmestad et al. | 83/151 |
| 4,164,808 | 8/1979 | Gudmestad et al. | 83/151 X |

*Primary Examiner*—Frank T. Yost

*Attorney, Agent, or Firm*—Ostrolenk, Faber, Gerb & Soffen

[57] ABSTRACT

Apparatus for measuring out a desired length of electric cable and transporting it to a work station comprises means for supplying the cable along a supply path through a guiding structure which includes a retractable guide element arranged under automatic control to be retracted when the end portion of the cable reaches the downstream end of the supply path so that during further cable supplying, the cable forms a loop which may hang downwardly with the leading end of the cable retained at or adjacent the downstream end of the supply path. When the desired length of cable has been formed into a loop, the cable is severed from the supply, and with gripping means holding the respective ends of the cable, a lateral displacement device is operated to convey the cable to a work station, at the same time bringing further gripping means into position ready for the next cycle of operation. At the work station any desired operation such as insulation stripping may be effected. .

14 Claims, 14 Drawing Figures

ELECTRIC CABLE PROCESSING

FIELD OF THE INVENTION

The present invention relates to electric cable processing and more particularly is concerned with the supply and handling of a desired length of insulated electric cable to permit operations to be effected on the end portions of the cable. For example it might be desired to strip the end of the cable and attach some form of electrical connector.

SUMMARY OF PRIOR ART

Such cable processing, in the past, has been effected using a machine having gripping units, and to permit the machine to operate on different lengths of cable, the gripping units have been relatively displaceably mounted. However, the time taken to adjust the machine when changing from one length of cable to another has been considerable, and considerable skill and care has been required to ensure that the desired setting is achieved with precision. Often such machines are tended by unskilled operators who may be less than attentative to correct adjustment of the machine and this can cause serious production problems.

OBJECTS OF THE INVENTION

The present invention is directed to providing an improved machine capable of handling electrically insulated cables for subsequent operations and in which the cable length may be selected from a substantial range with the machine being readily adaptable when a change of cable length is required.

SUMMARY OF THE INVENTION

The present invention is based on the concept of providing first and second cable gripping means which can remain at the same relative positions along a supply path for a wide range of cable lengths, a support or guide for guiding the leading end portion of the cable as it is advanced past the first gripping means and along a supply path towards the downstream second gripping means, the support or guide being retractable relative to the supply path to permit a loop to form in the central portion of the cable when the leading end of the cable is stopped, and the first gripping means being operable to grip the cable near its trailing end when the desired length of cable has been formed into the loop. Thus, with the leading and trailing end portions of the cable gripped by the first and second gripping means and the central portion of the cable in a loop, the cable may be subjected to further operations. For example the cable can be laterally displaced to a series of work stations at which, for example, the ends of the cable are trimmed to a precise location, insulation is stripped off and an electrical terminal is fitted, for example, by crimping.

The apparatus permits without adjustment of the machine the measuring out, supply and handling of a wide range of lengths of cable, the operator simply setting the machine so that the advancing means operates to supply a selected length of cable. In practice it is considered that it is convenient to manufacture the machine so that the minimum length of cable which can be measured out is about 300 mm and without making the machine unduly high, a maximum cable length of about 5 meters could be accommodated.

In accordance with a further feature which is preferably included in the machine, the guide means is removable or adaptable so as effectively to permit substitute guide means to be inserted and the respective gripping means moved closer together by a desired extent for short cables. In practice it is considered that a small selection of replacement guide means is all that is needed and preferably only the gripping means remote from the cable advancing means is moved. This can be easily provided by mounting the gripping means on a track arrangement which is secured to a frame mounted on support rollers with a screw threaded drive system which may be hand operated for displacing the track and gripping means and the replacement guide means could act as an abutment stop so that skill and care of the operator is minimized.

The apparatus may be dimensioned for accommodating cable in the range of 1 mm to 5 mm external diameter and with suitable replacement guide means very short cables of the order of 120 mm long could be handled. The machine could operate at relatively high speed, for example with a cable supply speed of the order of 1 meter per second.

In order to ensure trouble-free operation it is best for a continuous support configuration to be provided across the apparatus and the preferred form for the guide means is a vertically upwardly retractable plate acting as a front wall for a duct, the other walls of which are defined by a fixed member. When the guide means is retracted, continuing operation of the advancing means causes the cable to be displaced slightly forwardly and then to fall down into a loop. This arrangement is an alternative to another embodiment in which the guide means is in the form of a horizontally retractable plate on which the cable rests as it is fed in the initial phase of the machine operation.

The preferred form of the lateral displacement means is a chain-type conveyor having separate chains for the respective gripping means, which are in the form of a multiplicity of spaced gripping units fixed to the chain. The chains are adapted to be driven in synchronisation in a step-wise manner to advance the gripping means from station to station and it is best for the completed cable to be discharged after the last work station under gravity.

It may be desired to provide an end stop for locating positively the leading end of the cable and although a microswitch or equivalent device could be provided for activating retraction of the support means at the same time as operation of the first gripping means, this function could equally well be controlled by an electronic control unit associated with the means for advancing the cable from the supply.

BRIEF DESCRIPTION OF THE DRAWINGS

For illustrative purposes preferred embodiments of the invention will now be described, by way of example with reference to the accompanying drawings of which.

DETAILED DESCRIPTION OF PREFERRED EMBODIMENTS

There will now be described the first embodiment with reference to FIGS. 1 to 5 which illustrates somewhat schematically and in outline the first embodiment.

Figure 1:
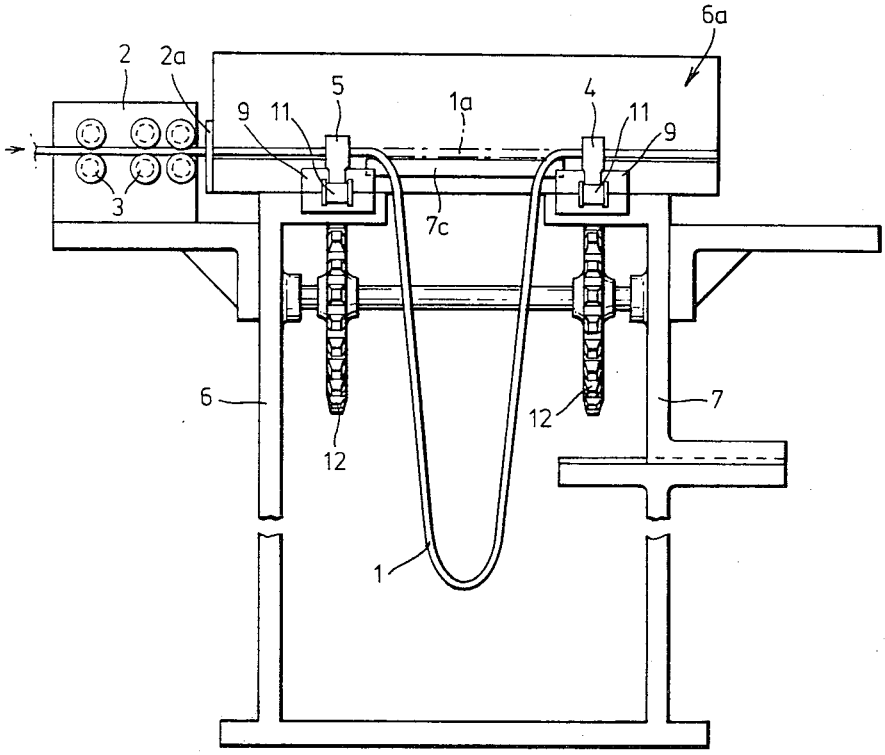
FIG. 1 is a front elevation, in outline, of a first embodiment of the invention.
Figure 2:
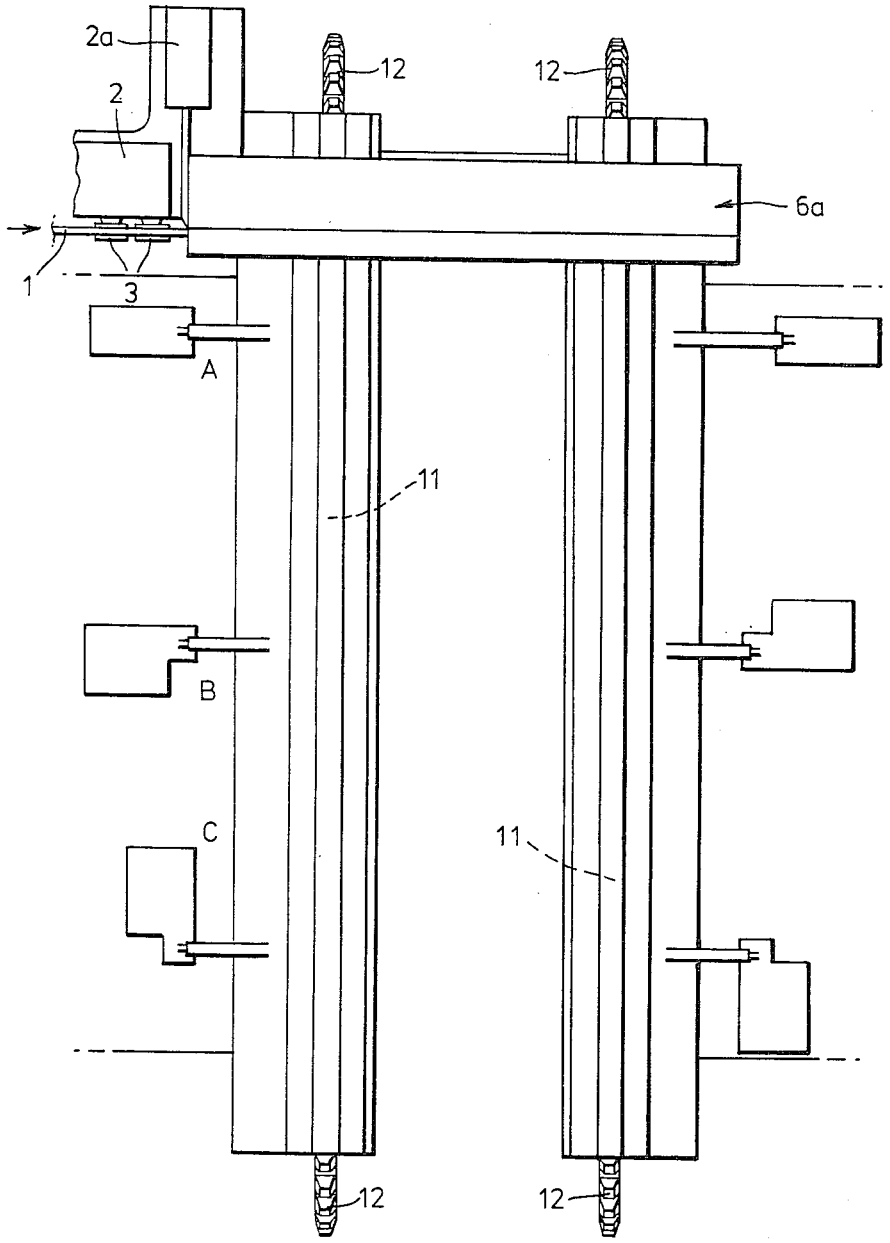
FIG. 2 is a plan of the apparatus of FIG. 1.

FIG. 1 illustrates a cable 1 after it has been measured in the apparatus, formed into a loop and gripped ready for lateral displacement to a work station, although the initial position of the cable is illustrated in dotted lines at 1*a* prior to retraction of guide means in the form of a retractable support.

The apparatus comprises an electronically controlled feed unit 2 having a series of three co-operating pairs of rollers 3 for advancing the cable, downstream and upstream gripping units 4 and 5 mounted on respective chain conveyors which are supported on a metal stand 6 of the machine, a cable guide unit 6*a* in association with a retractable support table 7*c* and a control shutter 6*b* controlled by solenoid 6*f* as described below for controlling the jaws of the grippers 4 and 5 and opening the end portions of the cable guide.

The gripping units 4 and 5 are mounted at an elevated location by virtue of the large vertical clearance provided by the metal stand 6 which, as seen in FIG. 1, has an adjustable upper righthand framework 7 to permit the downstream gripping unit 4 to be displaced to the left when very short cables are to be processed. For very short cables the machine is closed-up and the retractable support table 7*c* may be replaced by a shorter replacement table.

Figure 3:
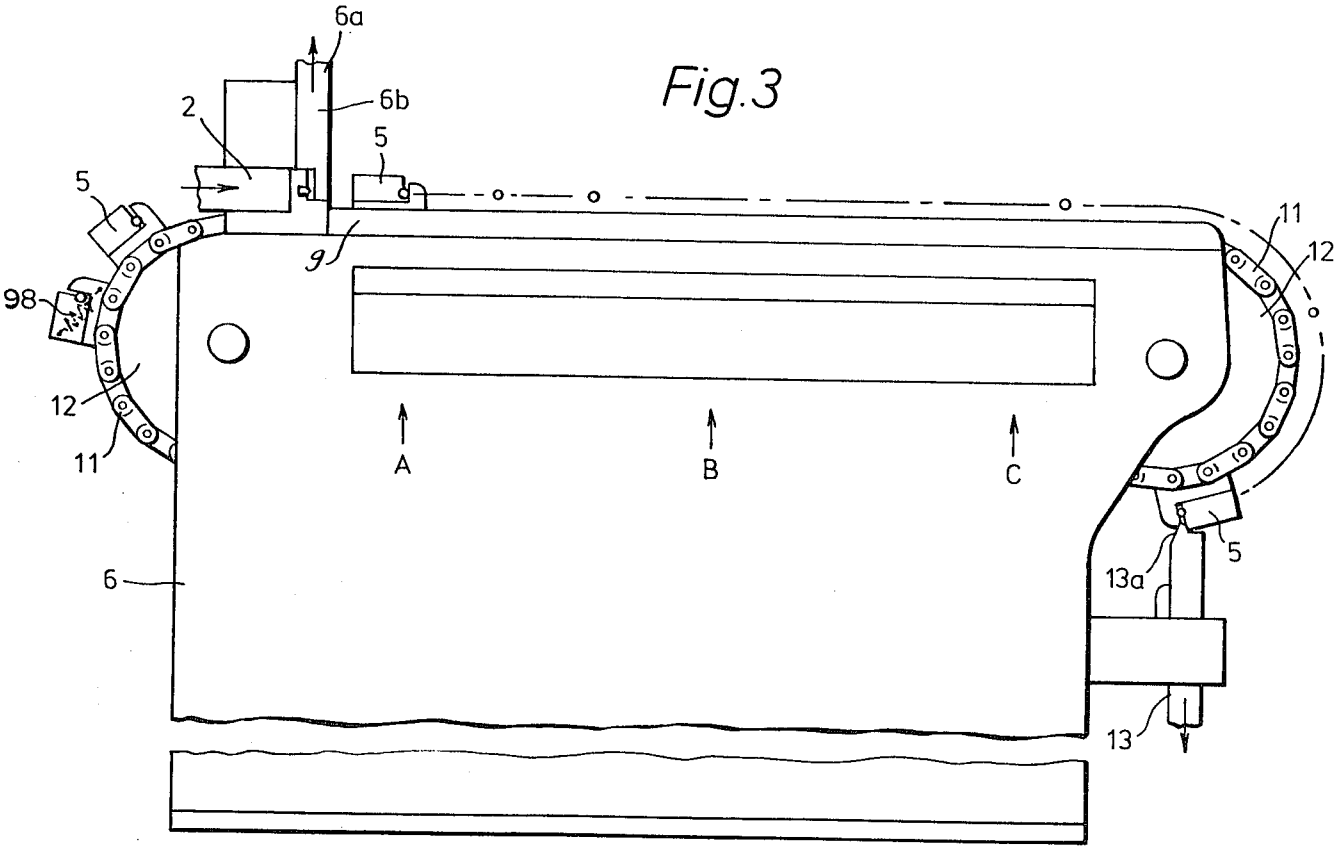
FIG. 3 is a side elevation of the apparatus.

As best seen in FIG. 3, a support track 9 extends laterally of the apparatus for supporting respective carrier chains 11 for the gripping units 4 and 5, the carrier chains passing over respective sprocket wheels 12, one pair of which are arranged to be driven in synchronism. In this embodiment, a series of three laterally offset work stations, labelled A, B, and C respectively are provided and at which any desired operating units may be mounted. The operating units might comprise a stripping unit Station A for stripping the ends of the cable, crimping units at Station B for a particular type of terminal and at Station C an alternative crimping unit for fixing a different type of terminal.

FIG. 3 illustrates in outline the cable guide unit 6*a* which comprises a vertical plate 6*b*. As shown in more detail in FIGS. 4 and 5, the plate 6*b* has at each side a recess at a lower portion with a projection 6*c* thereon aligned for impact with a nose of the gripper unit 4 or 5. As will be best seen from FIG. 3, the apparatus has a series of gripping units 4 and 5 on the respective chains 11 to be moved firstly to co-operate with the cable guide arrangement to receive a length of cable, then to advance the cable to the respective work stations, and finally to discharge the length of cable at a cable release mechanism 13.

The nose of each gripping unit 4 and 5 is adapted to strike the associated projection 6*c* on the cable guide as the gripping unit moves into a takeup position at which it stops. The projection 6*c* causes the jaws of the gripping unit to be opened against the biasing of a spring 98 (shown schematically in FIG. 3) just before the unit reaches its takeup position so that at the takeup position the jaws are open for receiving the cable. When the vertical plate 6*b* is displaced upwardly (as described in more detail hereinafter) the jaws are released to snap together under spring pressure to grip the length of cable for conveyance to the work stations when the chains 11 are driven. When the gripping units engage the release mechanism 13, the jaws are again opened by engagement with a finger 13*a* of the release mechanism whereby the cable is dropped.

Figure 4:
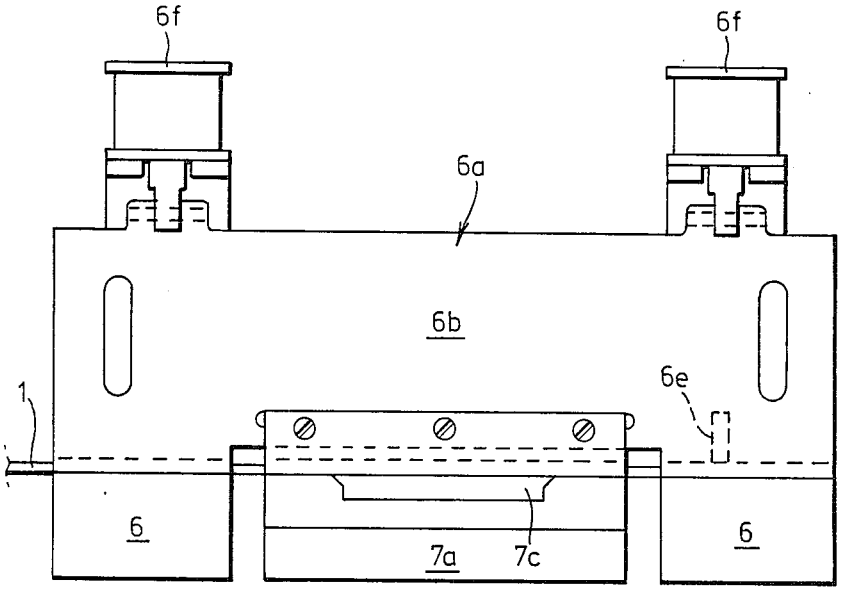
FIG. 4 is a front view of a part of the apparatus and illustrating a retractable support arrangement and cable guide unit.
Figure 5:
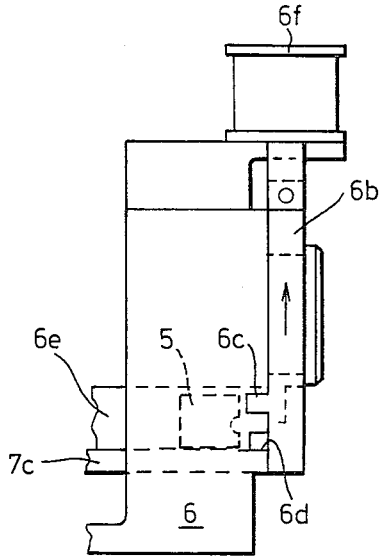
FIG. 5 is an end elevation of the apparatus of FIG. 4.

Further details will now be described with reference to FIGS. 4 and 5. The cable 1 is fed from the lefthand side of FIG. 4 behind the cable guide vertical plate 6*b*, the cable passing along a square cross-section shaped cavity 6*d* formed in a solid elongated casting providing the top part of the metal stand 6. The vertical plate 6*b*, as shown in FIG. 5, closes the cavity on the front side. As most clearly shown in FIG. 4, there is a centrally located loop release slide or support table 7*c* adapted to be retracted in the horizontal direction away from the vertical plate 6*b*, the release slide being mounted on a support structure 7*a*. On each side of the structure 7*a*, an aperture is provided for receiving the respective gripping units 4 and 5 on their respective chains.

FIG. 5 indicates in dotted outline a gripping unit 5 as it comes into engagement with projection 6*c* of the vertical plate and just before the jaws of the gripping unit are opened and in alignment with the square shaped cavity 6*d*.

Operation of the apparatus is as follows:

(1) The chain conveyor is driven to advance a pair of gripping units 4 and 5 into a takeup position at which the gripping units are opened and their jaws aligned with the square shaped cavity 6*d*. The conveyor stops.

(2) The cable advance unit 2 is operated under automatic control to supply a length of cable from a suitable reel along the cable guiding unit.

(3) When the leading end of the cable reaches the right hand end of the guide plate, a cable clamp 6*e*, comprising a horizontally slidable bar, is advanced through a cavity in an upper part of the support structure 6 towards the front plate 6*a* to clamp the leading end of the cable against the front plate.

(4) At the same instant the support table 7*c* is retracted by solenoid control in the opposite direction to the movement of the clamping bar 6*e*, thereby removing the surface which defines the bottom of the square shaped cavity 6*d* in the central region of the apparatus; this permits the cable to form a downwardly depending loop on further operation of the advancing means.

(5) After sufficient cable has been advanced, and this can be controlled automatically, the advancing means stops.

(6) Solenoids 6*f* are then operated to retract upwardly the vertical plate 6*b*; after an initial portion of the movement, the jaws of the gripping units 4 and 5 thereby being released to clamp around the cable and a cable cut off unit 2*a* is operated to sever the desired length of cable from the supply; further movement of the vertical plate 6*b* completely clears the opening to the guide and lifts the plate above the height of the top of the gripping units 4 and 5.

(7) The chain conveyor is advanced to move the gripping units carrying the cable to the next work station; after a portion of the motion sufficient to clear the gripping units from the location of the vertical plate 6*a*, the solenoids 6*f* are released to drop the plate back to the position 4 and 5 and, as the gripping units 4 and 5 reach work station A, the next set of gripping units are advanced to the takeup position.

Similar principles are embodied in a second form of the invention which will now be described with reference to FIGS. 6 to 14, these Figures illustrating in more detail a practical form of machine.

Figure 6:
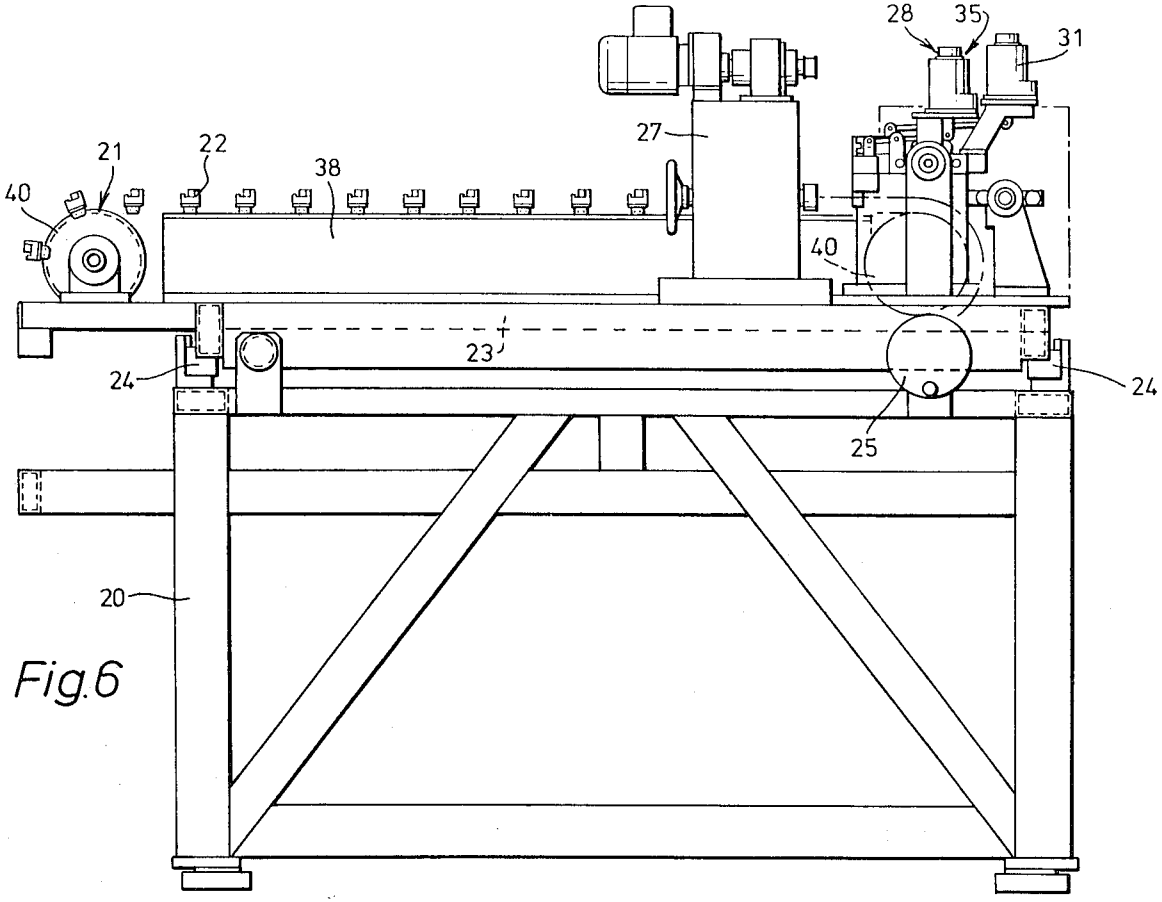
FIG. 6 is an overall side elevation from the right hand side of an apparatus embodying the invention.
Figure 7:
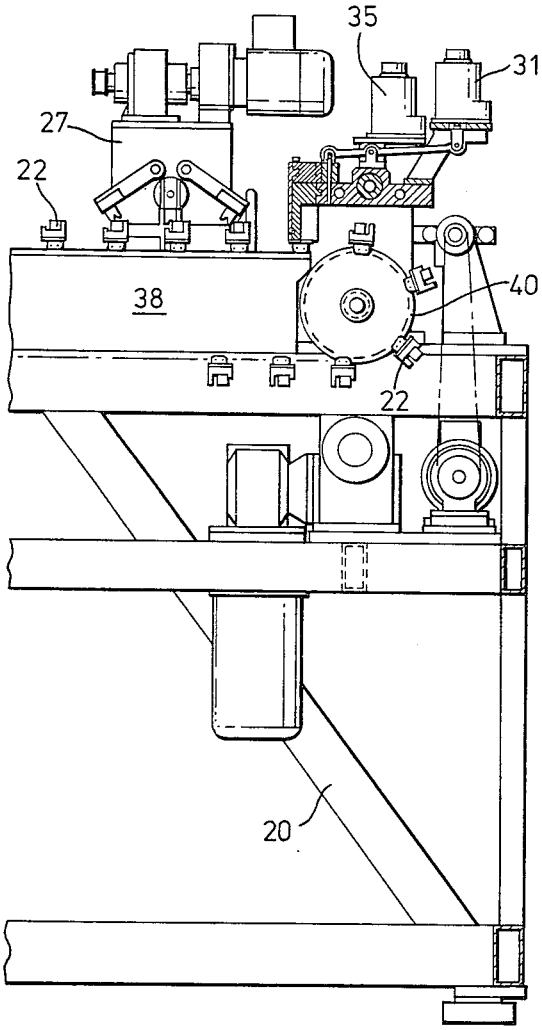
FIG. 7 is a partial cross-sectional side elevation taken through the central plane of the apparatus.

Referring first to FIG. 6, the machine comprises a tubular metal framework 20 mounting a chain conveyor 21 comprising a pair of spaced chains (omitted from the drawing) and a multiplicity of gripper units 22 on each chain are adapted to be moved sequentially from station to station. As is shown more clearly in FIG. 8, the metal framework includes a displaceable upper frame 23 having rollers 24 so that the frame can be adjusted sideways by a hand wheel 25 which drives a shaft 26 in screw threaded engagement with the upper frame.

At a cable dispensing station 28, an apparatus is provided for dispensing a cable in accordance with the present inventive concept and, as is clearly shown in FIG. 6, an insulation stripping device 27 is mounted at a first work station by being secured to the upper frame 23 and further space is available downstream relative to the chain conveyor for further work stations. A second insulation stripping unit can be provided on the opposite side of the machine and fixed to the top of the metal stand 20.

Figure 8:
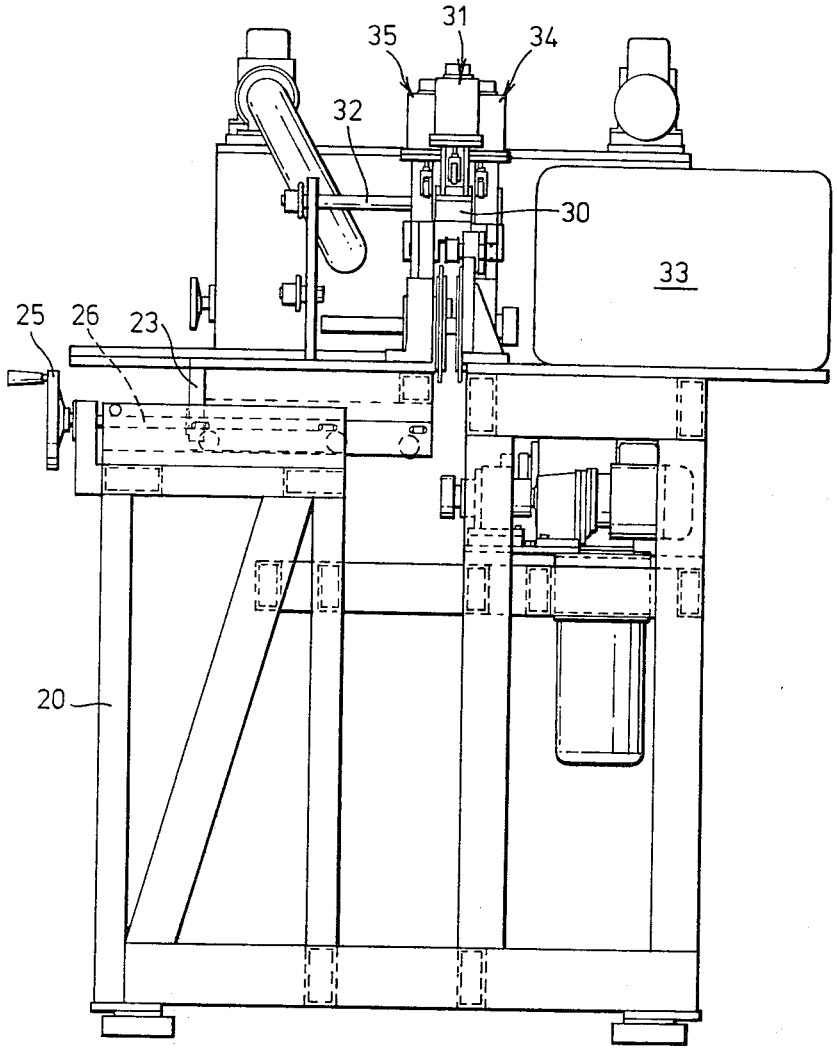
FIG. 8 is a rear elevation of the apparatus illustrating the machine after adjustment from a normal position to a closed-up position for very short cables.
Figure 9:
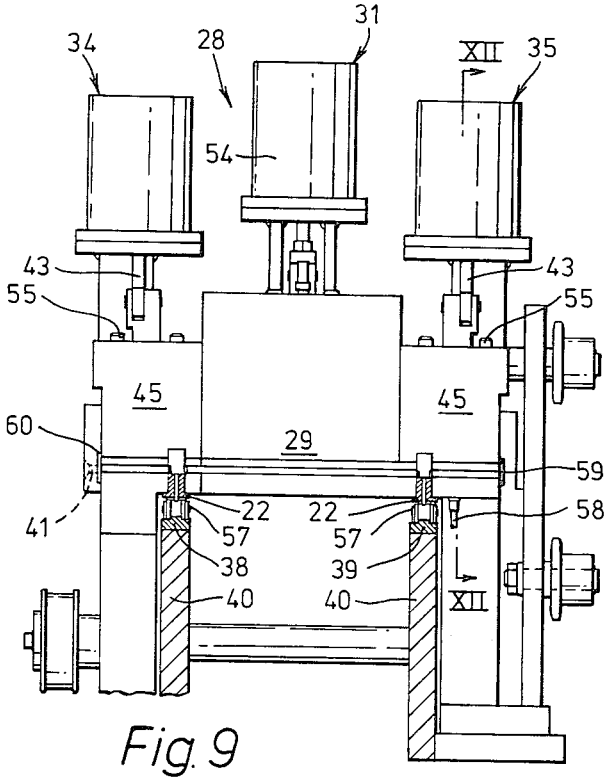
FIG. 9 is a detail front elevation showing the guide means and gripping means for the electrical cable.
Figure 10:
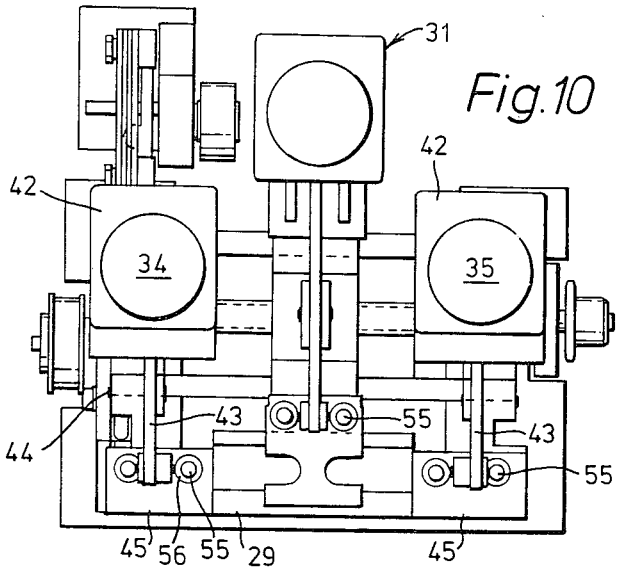
FIG. 10 is a plan of the detail shown in FIG. 9.

It will be appreciated that the insulation stripping machine 27 is moved laterally with the upper frame 23 if the machine is adjusted from its normal position as shown in FIGS. 9 and 10 to a closed position as shown in FIG. 8 for very short cables. Similarly the cable dispensing unit 28 is adapted to be closed-up after replacement of the normal loop-forming cable guide plate 29 with a special selected shorter plate. When the cable guide plate 29 has been removed and a replacement plate 30 installed, an operating unit 31 for the guide plate can be slid on a mounting shaft 32 towards the cable supply unit 33. For the purpose of controlling the jaws of the gripper units 22 and for controlling the leading and trailing ends portions of the cable, upstream and downstream gate units 34 and 35, described in detail below, are provided and are also mounted over the same shaft 32. However the upstream gate unit remains fixed and only the downstream gate 35 is moved across the machine when the machine is closed up as shown in FIG. 8.

FIGS. 6 and 9 show best the form of the chain conveyor 21. Metal support tracks 38, 39 are fixed respectively to the metal frame 20 and upper frame 23 and chains 22 (shown only in FIG. 9) run over the tracks and over respective sprocket wheels 40 at each end of the apparatus. Each of the gripper units 22 has a pair of jaws, one of which is movable and is spring biassed towards the other jaw so that the jaws are normally closed. As the gripper units are moved into engagement with the cable dispensing unit 28, a part of the respective gate units 34 and 35 engages the movable jaw to hold it open and after opening of a gate unit, the jaw is released to snap close and grip the cable.

The cable dispensing unit 28 will now be described in more detail with reference to the detailed views comprising FIGS. 9 to 12.

Figure 12:
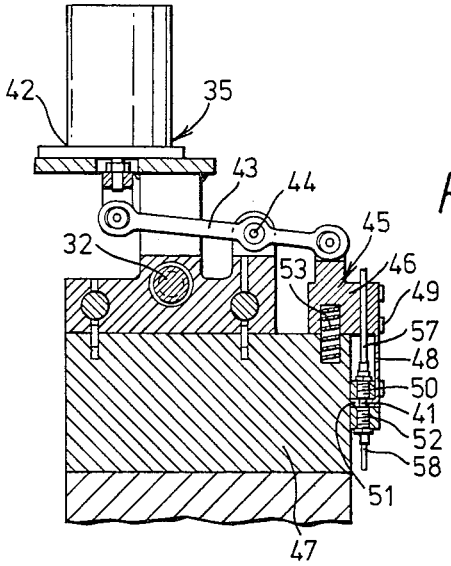
FIG. 12 is a partial cross-sectional side elevation taken along the line XII—XII of FIG. 9.

Electric cable is supplied from a cable supply unit (which is shown in detail in FIGS. 13 and 14) into a cable guide 41 which, as indicated in FIG. 9, has a flared inlet and, as best shown in FIG. 12, is of square cross-section and extends through the upstream gate unit 34, the operating unit 31 and the downstream gate unit 35. The gate units 34 and 35 are similar and each comprises an operating solenoid 42, a cable guiding shutter 45, and a rocker arm 43 pivotally mounted in a central region about a pivot axis 44 and pivotally connected at its respective ends to the solenoid and the shutter 45 of the gate unit. FIGS. 9 and 10 show the shutters 45 in the raised position leaving the cable guide 41 open to the front. In this configuration the gripper units will be gripping the cable and operation of the chain conveyor can commence. The solenoids 42 are not energized in this position, the gates each being biassed upwardly by a helical compression spring 53 shown in FIG. 12 in its compressed form. This produces a fast and reliable opening to the gate units.

FIG. 12 shows a shutter 45 in its normal lower position wherein the cable guide 41 is closed at the front and the energized solenoid maintains the spring 53 in compression.

The shutter 45 comprises an upper block 46 which rests on a main body structure 47, a front element 48 fixed by screws 49 (shown only in FIG. 12 for clarity reasons) to the upper block 46 and a bottom member 50, a lower edge of which defines the top of the cable guide 41. It will be seen that the rear of the cable guide is defined by the nose of a projecting rib 51 of the main body 47 and the bottom of the guide is defined by a bottom member 52.

To ensure accurate vertical movement of the shutters 45 and the retractable plate 29, each of the respective rocker arms has a pivotal connection at each end which permits some degree of free motion and a pair of guide pillars 55 engaging in the main block 47 are provided. In order to ensure low friction, a ball-bearing arrangement 56 surrounds each pillar.

For the purpose of controlling cable supply and actuating operation of the gate unit 35 and operating unit 31, a photo-electric detection device is mounted in association with the gate unit 35, the photo-electric device comprising upper and lower connections 57 and 58 shown in FIG. 12.

Figure 11:
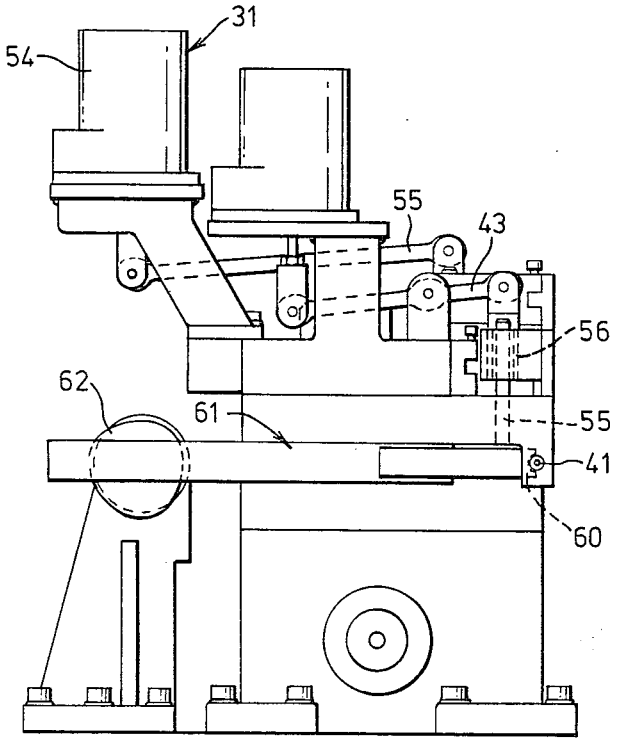
FIG. 11 is a side elevation from the left hand side of the structure shown in FIG. 9.

The most convenient form of operation is to feed the cable at a constant rate and after a predetermined delay from the first sensing of the presence of cable at the photo-electric unit, the solenoids of the operating unit 31 and the gate unit 35 are de-energized to permit the restoring springs to lift the retractable plate 29 and shutter 45 simultaneously causing the downstream gripper unit 22 to grip the cable and as further cable is advanced to permit a loop to form with the cable spilling forwardly and downwardly from the cable guide in the central region of the apparatus. An end plate 59 as shown in FIG. 9 provides a precise limit to the motion of the cable at the right hand end whereas at the left hand end of the apparatus at a similar position the blade 60 of a cable shear 61 is provided, the cable shear being driven by a double acting cam drive 62 as shown in FIG. 11.

The operating unit 31 is substantially similar to the gate unit 35 shown in FIG. 12 and also is operated by a solenoid 54.

Figure 13:
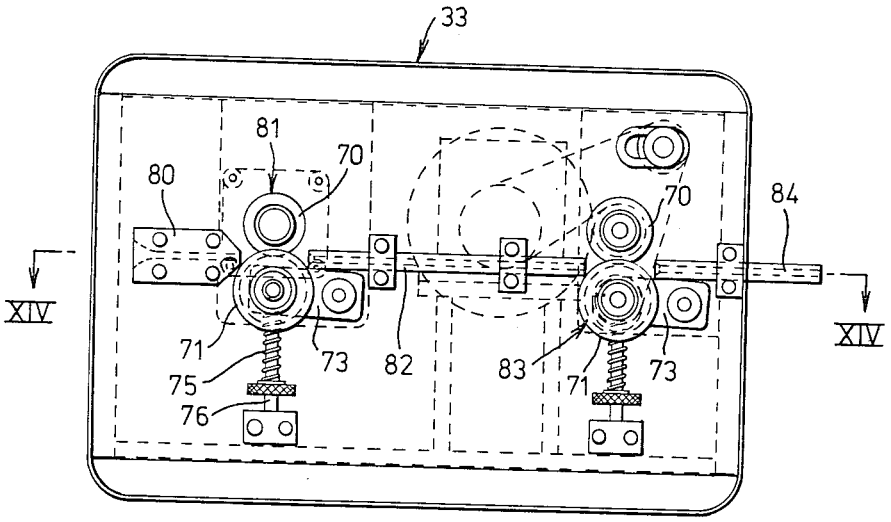
FIG. 13 is a front elevation showing in detail the device for feeding cable in the machine.
Figure 14:
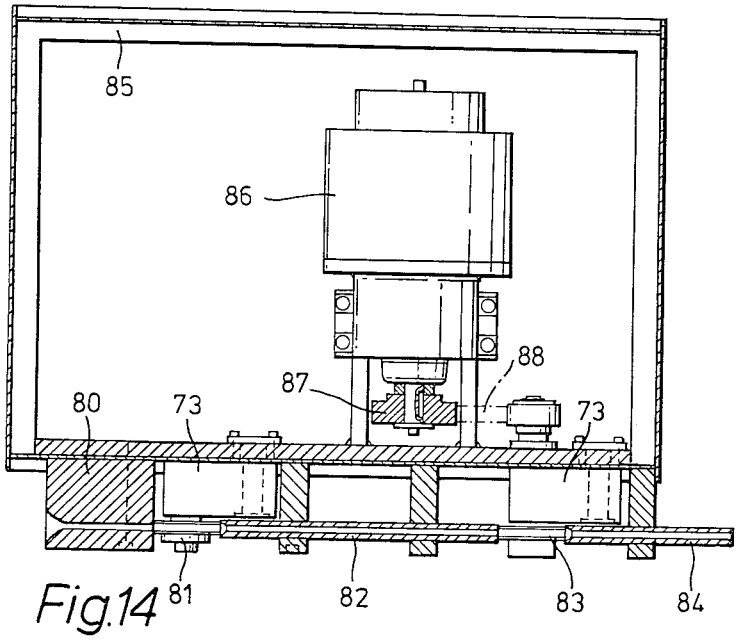
FIG. 14 is a cross-sectional plan of the feed arrangement taken along the line XIV—XIV of FIG. 13.

Referring now to FIGS. 13 and 14, the supply unit 33 for cable is shown. A reel of cable not shown in the drawing is mounted to the left of the unit and fed through a first guide block 80 to a pair of idler rollers 81 (which are connected to a measuring device) and then into a second tubular guide 82 before reaching a pair of driven rollers 83 which advance the cable through a discharge tube 84, immediately downstream of which a cutting device is located in the apparatus.

Within a casing 85 of the supply unit, an electric motor 86 is mounted, drive being transmitted from a drive pulley 87 by a drive belt 88 to both the pulley wheels of the driven pulleys 83. An automatic control circuit is provided for controlling the amount of cable supplied in accordance with a preset selection and the timing of the motor is also controlled in phased relationship to the other portions of the apparatus.

The respective sets of pulley wheels 81 and 83 each comprise an upper pulley 70 and a lower pulley 71 mounted on respective shafts secured in bearings in the front wall of the casing 65. The lower pulley is grooved and has a width sufficient to accommodate the widest cable to be used on the machine and the upper pulley has a sufficiently narrow peripheral portion to fit into the grooved lower pulley. Each of the lower pulleys 71 is mounted on a pivotally displaceable mounting arm 73, the lower pulley being spring biassed upwardly into engagement with the upper pulley by virtue of a helical compression spring 75 mounted on a guide pin 76.

I claim:

1. Apparatus for handling electrical cables comprising:

(a) a supply path for the cable extending from a supply location to a downstream end position, (b) means for advancing electrical cable substantially in its axial direction along said supply path, (c) first upstream gripping means and second downstream gripping means positionable at spaced locations along said supply path and selectively operable for gripping respectively a trailing end portion and a leading end portion of a length of cable, (d) displacement means selectively operable for displacing the first and second gripping means laterally of the supply path for carrying the length of cable to a work station, (e) guide means disposed between said spaced locations and displaceable relative to said supply path between a guiding position in which the cable is guided as it is advanced toward said downstream end position and a retracted position, (f) means for retaining the leading end portion of the cable at or adjacent said downstream end position, (g) retraction means selectively operable to retract the guide means from the guiding position to the retracted position in which the guide means permits, on further operation of the advancing means, the cable to form a loop between said spaced locations with said retaining means retaining the leading end portion of the cable, and (h) means for severing the length of cable from said supply upstream of the first gripping means.

2. Apparatus according to claim 1, wherein a vertical clearance below the supply path of approximately 1 to 3 meters is provided and the length of the guide means in the direction along the supply path is of the order of 20 cm.

3. Apparatus according to claim 1, wherein the guide means is of plate-like form and is retracted to said retracted position in a direction which is horizontal and opposite to the direction of displacement of said displacement means.

4. Apparatus according to claim 1, wherein said guide means is of plate-like form and is associated with a fixed member having a passageway extending along the supply path and having a front side thereof open, the guide means closing the front side of the passageway when in the guiding position and said fixed member defining at least in part a floor of the passageway and a rear side thereof.

5. Apparatus according to claim 4, wherein the guide means is vertically upwardly displaceable.

6. Apparatus according to claim 1, wherein with the guide means in the guiding position, said supply path is a substantially closed duct extending across the apparatus, a selectively openable upstream and downstream shutters being provided for opening the duct prior to operation of the lateral displacement means.

7. Apparatus according to claim 1, wherein each of said first and second gripping means comprises a series of gripper units mounted at spaced intervals along a continuous conveyor, the apparatus further comprising automatic control means for controlling a cycle of operation of the apparatus in response to an operator selected length for the cable, said cycle commencing with a gripper unit of each of said first and second gripping means at said spaced locations, operating the advancing means to advance the leading end of the cable to said downstream end position, operating the retraction means to retract the guide means, continuing to operate the advancing means so that the cable forms a loop which tends to hand downwardly, ceasing operation of the advancing means when the desired length has been supplied, causing the gripping means to grip the respective end portions of the cable, operating said severing means and operating the displacement means to advance the gripping units with the cable towards said work station thereby bringing a second pair of gripping units respectively of the first and second gripping means into said spaced locations.

8. Apparatus according to claim 7, wherein each of said gripper units has a pair of jaws spring biased to a closed position and abutment means for opening the jaws when in abutment with an operating element, the apparatus further comprising one of said operating elements displaceably mounted at each of said spaced locations and associated with a shutter-like plate normally closing the supply path at the spaced locations and means for automatically retracting said shutter-like plate so as to remove said operating elements from said abutment means immediately prior to operation of said lateral displacement means.

9. Apparatus according to claim 8 and further comprising release means having fingers located at the end of the continuous conveyor remote from said supply path for opening the jaws of the gripper units, the continuous conveyor having a return run below the level of the supply path.

10. Apparatus according to claim 1, wherein said retaining means comprises a cable clamp associated with a fixed member defining a duct and a retractable closure plate closing the duct normally on the side thereof to which the displacement means moves the gripper units, the cable clamp clamping the leading end portion of the cable against a wall of the duct, control means being provided for releasing the cable prior to the second gripping means gripping the cable and the duct being opened prior to operation of the displacement means, the cable clamp remaining retracted until a subsequent length of cable has been fed in a further cycle of machine operation to the downstream end position.

11. Apparatus according to claim 1, wherein said retaining means comprises a closed duct defined by a fixed member and a retractable front plate closing a side of the duct facing in the direction in which the displacement means moves the gripping means, the retractable front plate being mounted for movement in co-operation with the second gripping unit and operable to open a pair of jaws of the gripping unit as the gripping unit is brought into said spaced location, retraction of said front plate causing the jaws of the gripping unit to close and grip the cable and to open the duct.

12. Apparatus according to claim 1, and comprising upstream and downstream gate units having vertically upwardly retractable gate plates operated by respective solenoids connected to the gate plates through rocker arms, the gate plates having respective operating elements and in a first position the gate plates acting to close the supply path in the region of said spaced locations with the operating elements engaging the respective gripping means to cause the gripping means to be opened and after operation of the solenoids the gate plates being retractable vertically upwardly to open said supply path and release the gripping means whereby the cable is gripped and the apparatus further comprising control means for determining when the leading end portion of the cable has reached the downstream end position and operative to retract the gate plate of the downstream gate unit for causing the associated gripping means to close and grip the cable.

13. Apparatus according to claim 1, and including substitute guide means of shorter length along said supply path than said guide means and selectively insertable in place of said guide means to shorten the distance between the spaced locations, the substitute guide means being non-retractable whereby short lengths of cable shorter than the distance between spaced locations can be measured out and handled, said respective gripping means being movable towards one another by a corresponding amount.

14. Apparatus according to claim 1, wherein the advancing means comprises a first interengaging pair of rollers and a second driven interengaging pair of rollers downstream of the first pair of rollers, an electric motor for driving the driven pair of rollers and control means for controlling automatically the supply of cable so that the desired length of cable is advanced.

* * * * *